US006890367B2

(12) United States Patent
Alghamdi

(10) Patent No.: US 6,890,367 B2
(45) Date of Patent: May 10, 2005

(54) DYNAMIC SAND DRIFT BARRIER

(75) Inventor: Abdulmalik A. Alghamdi, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 26 days.

(21) Appl. No.: 10/622,326

(22) Filed: Jul. 17, 2003

(65) Prior Publication Data

US 2005/0013931 A1 Jan. 20, 2005

(51) Int. Cl.[7] ..... B01D 33/00
(52) U.S. Cl. ..... 55/406; 256/12.5; 416/197 A
(58) Field of Search ..... 55/406; 256/12.5; 416/197 A, 197 R

(56) References Cited

U.S. PATENT DOCUMENTS

| | | | |
|---|---|---|---|
| 1,697,574 | A | 1/1929 | Savonius |
| 1,766,765 | A | 6/1930 | Savonius |
| 3,382,627 | A | 5/1968 | Vartia |
| 3,473,786 | A | 10/1969 | Luebke |
| 4,405,262 | A | 9/1983 | Nagashima |
| 4,549,724 | A | 10/1985 | Taillandier |
| 4,726,714 | A | 2/1988 | MacArthur |
| 4,784,568 | A | 11/1988 | Benesh |
| 4,830,570 | A | 5/1989 | Benesh |
| 4,838,757 | A | 6/1989 | Benesh |
| 5,494,407 | A | 2/1996 | Benesh |
| 6,053,479 | A | 4/2000 | Lang et al. |
| 6,283,711 | B1 | 9/2001 | Borg et al. |

FOREIGN PATENT DOCUMENTS

JP 05215062 A * 8/1993

OTHER PUBLICATIONS

Alghamdi, et al., *Energy Conversion and Management*, 2001, 42, 1143–1156.

* cited by examiner

*Primary Examiner*—Robert A. Hopkins
(74) *Attorney, Agent, or Firm*—Abelman, Frayne & Schwab

(57) ABSTRACT

A dynamic sand drift barrier stops and accumulates sand, snow or other heavier-than-air particles suspended in moving air currents, to perform as a fence and adjust its position to maintain the operative portions above the top of the accumulated particles using energy derived from the particle and wind movement. The dynamic drift barrier is made of a horizontal Savonius windmill presenting the fence frontal area perpendicular to the prevailing wind direction. Blown particles will rotate the Savonius windmill transferring the longitudinal motion into rotational motion. Two sets of pulleys and related mechanically operative power transmission serves to translate the rotational energy into axial force-displacement energy using four slider crank arm mechanisms. Transported sand will be deposited by the Savonius windmill, and the blown sand energy will drive the four legs of the barrier vertically so that each foot will readjust its height to retain the position of the drift barrier atop the sand dune.

30 Claims, 8 Drawing Sheets

DYNAMIC SAND DRIFT BARRIER

FIELD OF THE INVENTION

The invention relates to dynamic sand fence or sand break to stop or reduce the advancement of wind-borne sand or other heavier-than-air particles, such as snow, across the earth's surface.

BACKGROUND

Passive fences have been used to stop wind-borne transport across dessert terrain. However after a period of time, passive fences become full of sand and their barrier efficiency drops to zero. Other prior art solutions to the problem of wind-borne sand and snow include vertical extension of the existing fence, building a new fence at a different location, and removal of accumulated particles from the base and downwind shadow area of the fence line.

Other approaches to halting or slowing sand drift include planting sand vegetation and sand stabilization using chemical agents, e.g., crude oil. However, vegetation is difficult to maintain in desert and arid lands having harsh environments. Chemical agents can also present potential danger to the under ground water supply and to animals and plants. Application of crude oil to the surface of the sand suppresses vegetation and has a limited useful term, especially if the area is destabilized by animal movement and/or transportation systems.

Sand or snow barriers having movable surfaces responsive to the direction and/or velocity of the airborne particles have been disclosed in the prior art. For example, U.S. Pat. No. 4,549,724 describes a self-orienting barrier fence that moves to maintain its slated surface perpendicular to the prevailing wind.

Protective fencing formed of a plurality of horizontally arranged slats or vanes that are upwardly curved and pivotally mounted along the horizontal axis are disclosed in U.S. Pat. No. 3,473,786. The horizontal vanes are attached to a fixed frame and respond to changes in the angle of attack of the wind to provide the maximum lift to the air stream containing the particles to carrying the particles over a roadway or other right-of-way, rather than cause them to fall at or downwind of the device.

A snow fence having a rotatably-mounted plate mounted on a fixed base is described in U.S. Pat. No. 6,053,479 as a passive snow removal system, using a triangular plate to create vortices in a downwind area that scour the ground and prevent accumulation and drifting.

As will be apparent to one of ordinary skill in the art, the prior art barriers or fences provided with movable assemblies are also vulnerable to sand or snow accumulation around their stationary supports which can eventually render them partially or wholly inoperable.

I have invented an apparatus which performs as a sand fence and at the same time will adjust its position to maintain the operative portions above the top of the sand dune accumulated thereby. In particular, the present invention relates to a dynamic sand or snow fence or break that moves vertically upward as sand accumulates therebeneath to maintain its fully-operable position above the surface of the accumulating sand particles at its base.

The dynamic sand barrier or break is highly efficient in removing airborne particles carried along the earth's surface in order to protect downwind terrain and facilities from sand advancement and drifting. It also provides a self-positioning and self-orienting sand barrier whose power requirements are met by the actual wind that is driving the particles for which it serves as a barrier.

SUMMARY OF THE INVENTION

The apparatus of the invention is a dynamic drift barrier which can be utilized to stop and accumulate sand, snow or other heavier-than-air particles suspended in moving air currents. For convenience in the following description, the reference to sand will be understood to include all such particles.

This apparatus performs as a sand fence and at the same time will adjust its position to maintain the operative portions above the top of the sand dune, or the accumulated sand, using energy derived from the sand and wind movement. Neither an external source of power, e.g., electricity, is needed to raise the device, nor is human effort needed to extend the barrier vertically.

In a further preferred embodiment, the apparatus can be retained or tethered to a positioning device to assure that its vertical self-adjustments do not result in transverse movements away from its predetermined desired starting position. The positioning device can be a vertical rod or shaft, such as a length of pipe, that is driven into the ground and to which a portion of the frame member or other part of the assembly is attached for vertically slidable movement. For example, an eye-bolt can be slidably positioned on a length of standard fence pipe that is driven into the ground at the place where the windmill is to be positioned. The threaded end of the eye-bolt can then be secured to the frame member. More than one positioning device can be used with each windmill assembly.

The dynamic sand drift barrier is made of a horizontal Savonius windmill presenting the fence frontal area perpendicular to the prevailing wind direction, and made of a frame structure with four guided legs. The Savonius windmill is welded to a shaft carried by two bearings located at the supporting frame. One of the Savonius blades is made a little heavier than the other one to ensure the perpendicularity of the windmill to the ground and thus easy start up. Two sets of pulleys are mounted on the shaft. Four V-belts are used as the power transmission means and connect these pulleys to four slider crank mechanisms. Each slider crank mechanism is pivoted to a guided leg. When sand is being driven by wind, the sand grains rarely rise higher than about 1 meter above the ground, and the average height is less than about 1 meter. Accordingly for the present invention, the barrier is preferably located within about ¾ meter to about 1¼ meter, but preferably about one meter or less above the ground and on the top of the sand dune or sand sheet surface.

The fence operates as follows: blown sand will rotate the Savonius windmill transferring the longitudinal motion into rotational motion. The shaft will rotate with the Savonius windmill and the two pulleys attached to this shaft will translate the rotational energy into axial force-displacement energy using four slide crank mechanisms. Each slider crank mechanism drives a guided leg of the barrier. The amplitude of the crank mechanism (i.e., step size or stroke length) can be adjusted to provide the least amplitude movement of the leg necessary to keep the barrier up on the top of the sand dune and thus avoid sand accumulation. Transported sand will be deposited by the Savonius windmill working as a very wide horizontal slat, and the blown sand energy will drive the four legs of the barrier vertically so that each foot will readjust its height, as the sand is blown, and as the sand is deposited.

In a preferred embodiment, the apparatus for depositing particles carried in moving air currents comprises a frame member, a generally horizontal axle mounted for rotation on said frame member, and a plurality of blades secured to the horizontal axle for receiving and depositing such particles under the frame member, and for rotatably moving with the axle caused by movement of the air currents and particles. A plurality of vertically displaceable supporting members are attached to and depend from the frame member. A lifting device is associated with the frame member and each of the plurality of supporting members for vertically displacing each of the plurality of vertically displaceable supporting members. Power transmission means is operatively associated with the horizontal axle and each of the lifting devices for transferring the energy of rotation of the horizontal axle to each of the lifting devices for causing vertical displacement of each of the plurality of vertically displaceable supporting members, whereby rotation of the horizontal axle by movement of the plurality of blades produces a periodic vertical displacement of each of the supporting members to lift the frame structure with respect to the deposited particles. Preferably the plurality of blades includes at least two blades in the form of a Savonius windmill.

The blades can be coated with an abrasion-resistant material such as polyvinyl chloride, or hardened metal alloy, or they may be made entirely of an abrasion resistant material such as plastic, or composite materials.

The apparatus further comprises amplitude control means for controlling the stroke of the periodic vertical displacement of the supporting members. Power transmission means is provided which includes a mechanical power train from the axle to each of the plurality of lifting devices, and the plurality of vertically displaceable supporting members include four supporting members. An articulated support plate may be attached to each of the plurality of supporting members at the free ends. Alternatively, a plurality of such support plates may be attached to the exterior surface of at least one of the plurality of supporting members. Also a signal transmission may be operatively connected to the axle. In a preferred embodiment the free ends of the supporting members are positioned on the earth's surface, the horizontal axle being supported at a distance of about one meter above the surface and normal to the prevailing direction of air currents carrying suspended particles, whereby the frame member self-adjusts its vertical position to maintain the axle and blades above the deposited particles. The vertically displaceable supporting members each preferably comprise a guiding tube having a piston slidable therein, the slidable piston having a crank arm pivotably attached thereto, the crank arm being connected to the power transmission means to slidably move the piston upwardly and downwardly within the guiding tube. The piston has a leg member attached thereto on the side opposite the crank arm, the leg member having a foot attached to the free end thereof for engagement with the sand to support the frame member thereon.

The crank arm can be made adjustable to vary the length of the stroke. Alternatively, the crank arm may include a plurality of apertures for attachment to the power transmission means by a pin made to extend through a selected aperture and into the power transmission means. The power transmission means preferably comprises a pair of pulleys on each end of the axle, and a pair of drive belts connected to the axle and the pulleys. The crank arm of each supporting member is attached to the pulleys at a selected radial location so as to move upwardly and downwardly when the pulleys rotate caused by energy transmitted by air currents and particles carried thereby.

The power transmission means preferably comprises a pair of pulleys on each end of the axle, and a pair of drive belts are connected to the axle and the pulleys, the crank arm of supporting member being attached to the pulleys at a selected radial location so as to move upwardly and downwardly when the pulleys rotate caused by energy transmitted by air currents and particles carried thereby. Preferably the point of connection between each crank arm and each pulley is offset by about 90 degrees from the point of connection of the next adjacent pulley. The pulley is operated by a V-belt.

In one preferred embodiment, the apparatus for depositing particles carried by moving arm current, which comprises a frame member, a horizontal axle bearing mounted to the frame member for rotation; at least two windmill blades attached to the axle to form a Savonius-type windmill for engagement by the air currents and for receiving and depositing such particles beneath the frame member, said windmill blades rotatably moving with the axle by energy imparted thereto by the air currents and particles carried thereby. A plurality of vertically displaceable supporting members are attached to the frame member and depending therefrom, each supporting member including a guiding tube, a piston slidable upwardly and downwardly within the guiding tube; a crank arm attached to the upper portion of the piston, and a leg member attached to the lower portion of the piston, the leg member having a support foot attached to the lowermost free end thereof. Power transmission means is adapted to convert energy from the wind currents and particles carried thereby to rotational movement of a plurality of pulleys, each pulley having at least one of the crank arms attached thereto, whereby rotation of the pulleys causes correspondingly rotation and upward and downward movement of each crank arm to cause each support leg and attached support foot to move upwardly and downwardly with a sand pile accumulated by the windmill to cause the frame member to periodically rise to maintain a position within a predetermined dimensional range at or near the top of the sand pile.

Broadly stated, the apparatus for depositing particles carried in moving air currents comprises a frame member positionable on a surface and in the air currents at a predetermined height location above the surface. A generally horizontal axle is mounted for rotation on the frame member, and a plurality of windmill blades attached to the axle to form a Savonius-type windmill for engagement by air currents and for receiving and depositing and accumulating such particles beneath the frame member so as to progressively raise the level of the surface of such particles on which the frame member is positioned, the windmill blades rotatably moving with the axle by energy imparted thereto by the air currents and particles carried thereby. The apparatus further comprises means to maintain the height of the frame member with respect to the surface of such particles within a predetermined dimensioned range by progressively raising the frame member as such particles are deposited and accumulated.

The means to maintain the height of the frame member with respect to the surface of such particles comprises a plurality of vertically displaceable supporting members attached to and supporting the frame member, each supporting member adapted to progressively raise the frame member in accordance with the level of the surface of such particles as such particles are accumulated beneath the frame member, to maintain the height of the frame member with respect to the upper surface of such particles within a predetermined range.

The invention also relates to a method of removing and depositing air-borne particles from air currents moving proximate a surface comprising providing a self-adjusting Savonius windmill apparatus, the axle of which is mounted to a frame member equipped with a plurality of vertically displaceable supporting members, and positioning the windmill apparatus on a surface and in the air currents with the axle normal to the prevailing direction of the air currents, whereby particles impacting the blades of the windmill are removed from the air currents and deposited and accumulated on the surface.

The method further comprises positioning a plurality of the windmill apparatuses in a flanking array to thereby reduce the advancement of sand over an area of the surface downwind of the plurality of windmill apparatuses.

BRIEF DESCRIPTION OF THE DRAWINGS

Preferred embodiments of the invention are described hereinbelow with reference to the drawings wherein.

DETAILED DESCRIPTION OF THE INVENTION

Figure 1:
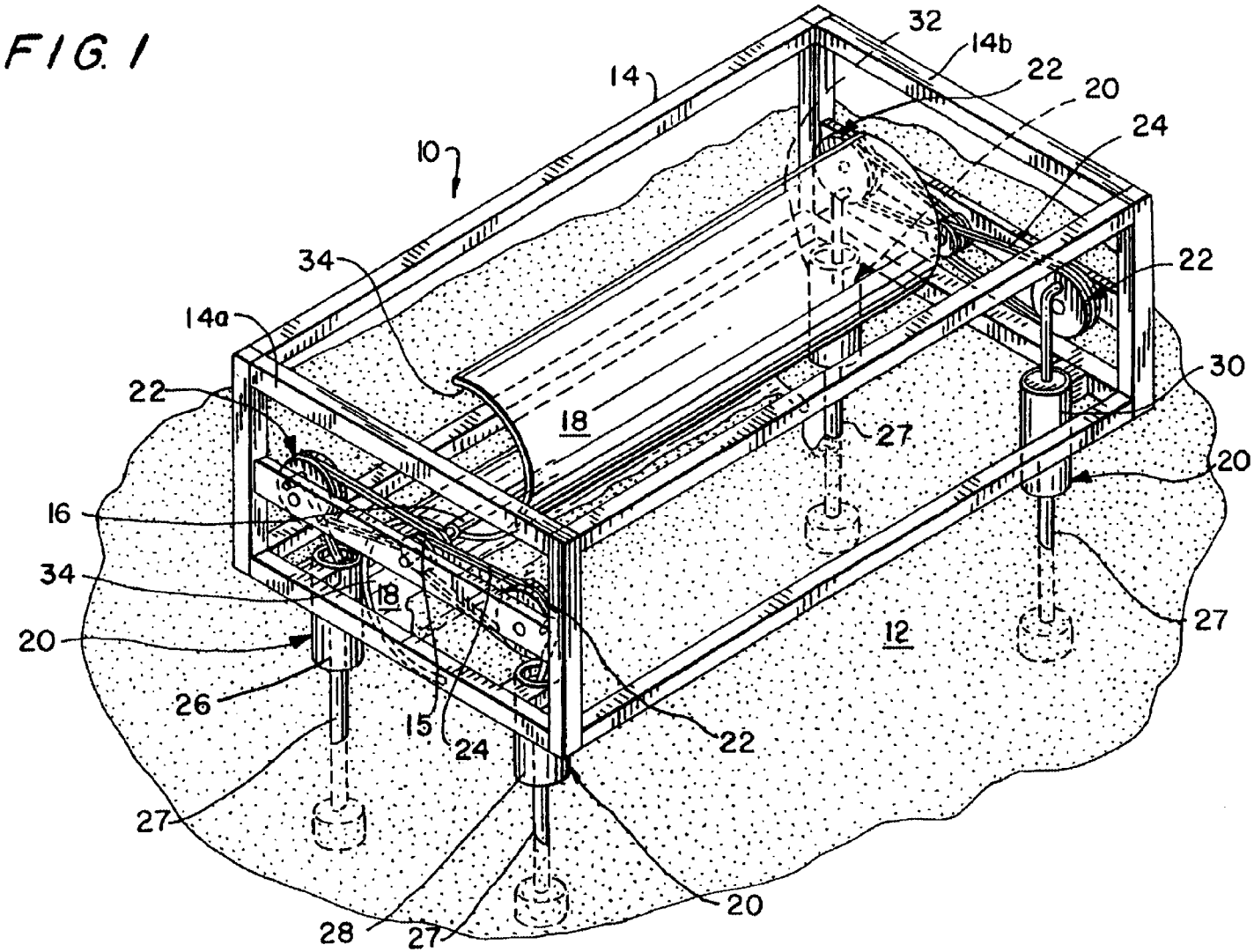
FIG. 1 is a left side perspective view from above, of a dynamic drift barrier constructed in accordance with the present invention.

Referring initially to FIG. 1, the apparatus 10 of the invention is a dynamic drift barrier which can be utilized to stop and accumulate sand, or other heavier-than-air particles 12 suspended in moving air currents, while maintaining the drift barrier in an exposed and continuously elevated position. Particles such as snow are also contemplated. For convenience in the following description, the reference to sand will be understood to include all such particles.

Referring initially to FIG. 1, the apparatus 10 includes a frame member 14; a horizontal shaft or axle 16 mounted on bearings 15 for rotation on the frame member 14; a pair of windmill blades 18 secured to the horizontal axle 16 to form a windmill of the Savonius type; a plurality of vertically displaceable supporting members generally designated as 20, attached to and depending from the frame member 14; lifting device 22 associated with the frame member 14 and each of the plurality of supporting members 20; power transmission means 24 operatively associated with the horizontal axle 16 and each of the lifting devices 22, whereby rotation of the horizontal axle 16 produces a periodic and alternating vertical displacement of each of the supporting members 20 as will be described in further detail. For convenience of illustration, each supporting member 20 is separately and individually shown in FIG. 1, and will be referred to generally as supporting member 20, or where specifically required, by the specific designation for each supporting member 26, 28, 30 and 32.

Although the windmill shown in the drawings includes a pair of blades 18 directly attached to the axle 16, they may alternatively be made in various configurations, such as the offset blade arrangements disclosed in U.S. Pat. Nos. 1,697,574 and 1,766,765 to Savonius, the disclosures of which are incorporated herein and made part of the disclosure.

The apparatus 10 is a drift barrier which performs as a sand fence and at the same time will adjust its position to maintain the operative portions above the top of the sand dune, or the accumulated sand 12, using energy actually derived from the sand particles 12 and wind movement. Neither an external source of power, e.g., electricity, is needed to raise the apparatus 10, nor is human effort needed to extend the apparatus 10 vertically. The apparatus 10 therefore serves as a dynamic barrier to control sand accumulation in selected areas.

Figure 2:
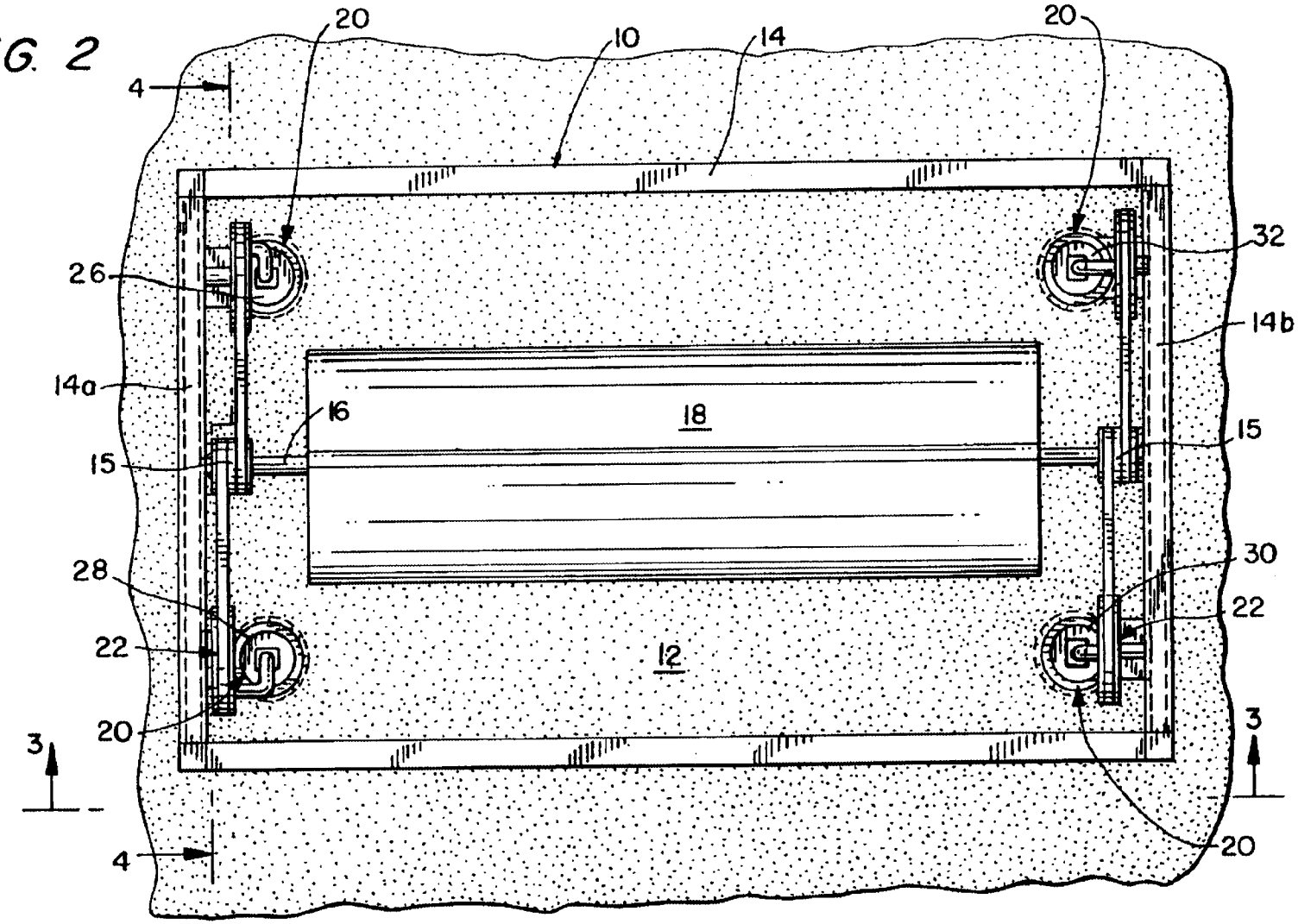
FIG. 2 is a top plan view of the dynamic drift barrier of FIG. 1.

Referring now to FIG. 2 there is shown a top plan view of the dynamic drift barrier 10 of FIG. 1, illustrating an exemplary embodiment in which the plurality of vertically displaceable supporting members 20 are arranged in pairs on respective sides of the barrier 10. As noted previously, for convenience of illustration, the left pair of supporting members are designated 26, 28 and the right pair of supporting members are designated 30, 32.

Figure 3:
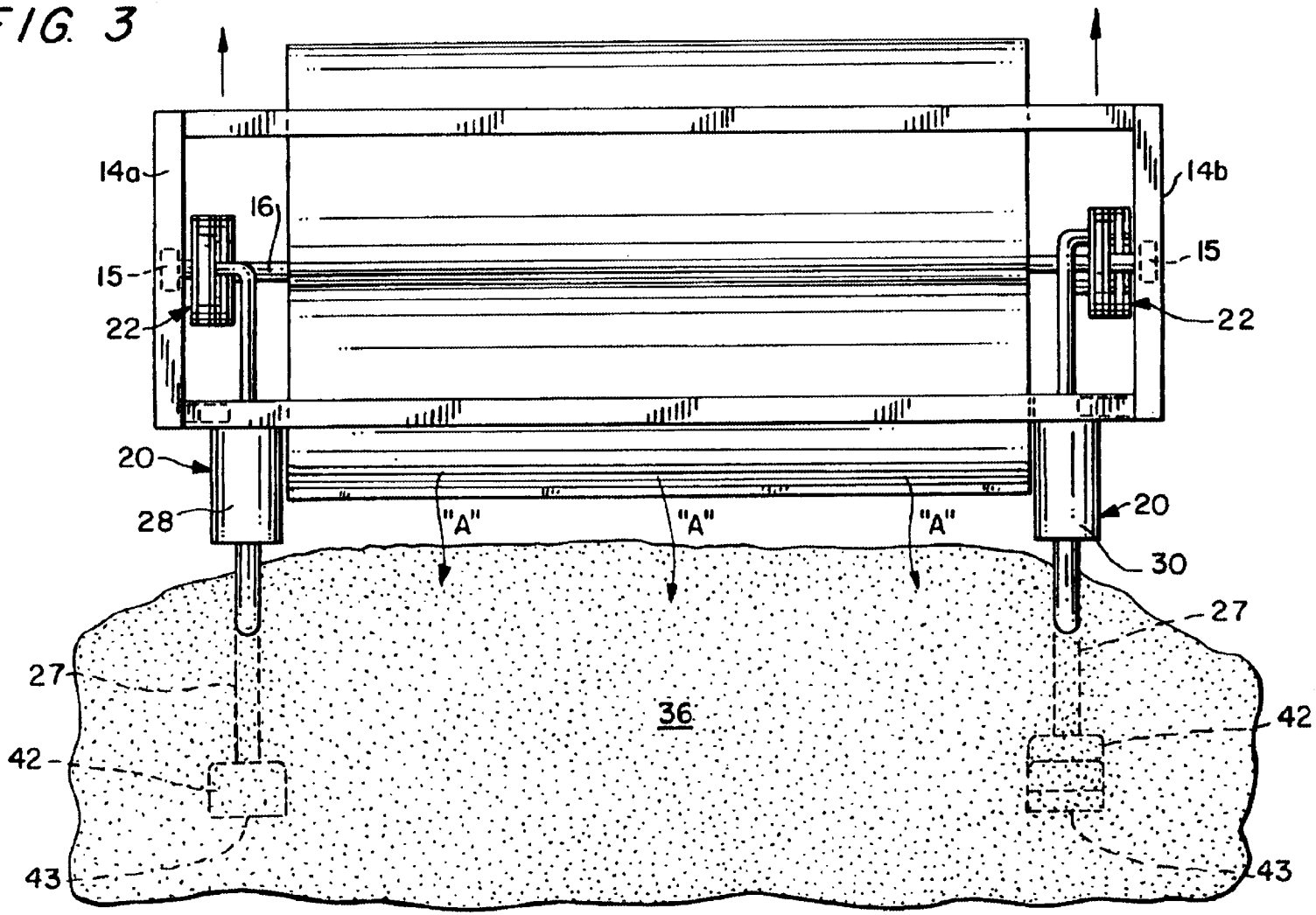
FIG. 3 is a front elevational view of the dynamic drift barrier of FIG. 1.

Referring now to FIG. 3 in conjunction with FIGS. 1 and 2, each vertically displaceable supporting member 20 has a foot 42 at a free end of leg 27, and support plate 43 attached or otherwise formed integral with the bottom of the foot 42. When the apparatus 10 is horizontal, the support plate 43 is generally horizontal with respect to the vertically oriented longitudinal leg of each supporting member.

As best seen in FIG. 1, for each pair of supporting members 26, 28 and 30, 32 operation of the axle 16 causes complementary symmetrical movement; that is, as a first supporting member 26 rises and falls a predetermined distance, its complementary partner supporting member 28 also rises and falls, respectively, the same predetermined distance. A second pair of supporting members 30, 32 also operate to simultaneously rise and fall the same predetermined distance, respectively.

The plurality of vertically displaceable supporting members 20, forming respective pairs of supporting members 26, 28 and 30, 32, can be identically constructed and made to move vertically by separate and independent distances and to operate asynchronously with respect to the other supporting members 26, 28 and 30, 32, as shown in the exemplary embodiment in FIG. 3. As shown in the drawings, each supporting member 26, 28, 30, 32 of a given pair (28, 30 and 26, 32) is out of phase with the other supporting member of the pair by a predetermined phase angle. In the embodiment shown, the phase angle is 90 degrees.

FIG. 3 is a front elevational view of the dynamic drift barrier 10, showing the overall movement of the barrier 10 in relation to the sand 12. As the blades 18 are rotated by pressure from movement of blowing sand and wind against the surfaces 34 of the blades 18, the blowing sand is caught by the rotating blades 18 and deposited generally beneath the blades 18 as indicated by arrows "A", to form a sand pile 36. The surfaces 34 of the blades 18 can include abrasion-resistant material, such as a plastic coating (i.e., polyvinyl chloride or the like), hardened metal alloy, or they may be made entirely of composite materials, which will also serve to prevent sticking of the sand to the blade surfaces. Alternatively, the blades may be made entirely of such abrasion resistant material.

Simultaneously with the deposition of the sand 12 by the blade 18 to form the sand pile 36, the rotation of the blades 18 causes rotation of the shaft 16, which in turn, causes a rising-and-falling motion of the plurality of vertically displaceable supporting members 20 to incrementally raise the apparatus 10 upward through the sand 12. As can be seen in the FIGS., and particularly FIG. 3, the apparatus moves upwardly with the continuously growing pile 36 of sand.

Figure 4:
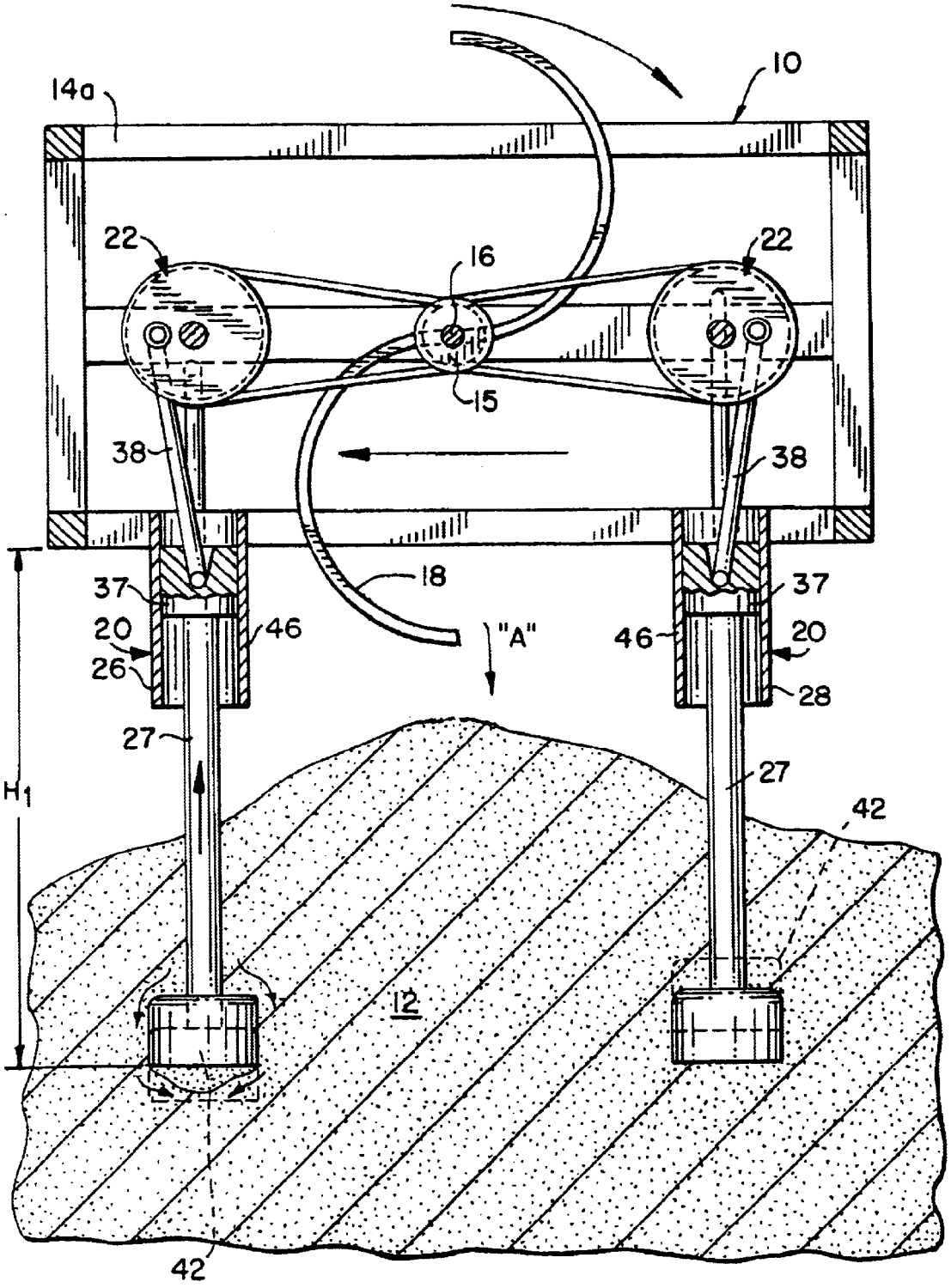
FIG. 4 is a left side elevational view, partially in cross-section, taken along lines 4—4 of FIG. 2.

FIG. 4 is an elevational view, partially in cross-section, taken along lines 4—4 in FIG. 2 of the dynamic drift barrier 10 showing the disposition of the sand on pile 36 and the lifting of the overall barrier 10 as described above with references to FIG. 3.

The dynamic sand drift barrier 10 thus incorporates a horizontal Savonius windmill as described herein and known in the art, for example, in U.S. Pat. No. 1,697,574 to Savonius and U.S. Pat. No. 1,766,765 to Savonius which are incorporated herein by here and made a part of this disclosure. The dynamic sand drift barrier 10 presents a fence-like frontal barrier perpendicular to the prevailing wind direction and a frame structure, including the frame member 14, with the plurality of vertically displaceable supporting members 20 embodied, for example, in the form of four guided legs 27, respectively forming a part of supporting members 26, 28, 30, 32 as shown in FIG. 2. The Savonius windmill includes the blades 18 welded or otherwise attached to the shaft 16 which acts as a horizontal axle carried by two bearings as signal transmission means located at the supporting frame member 14, with the bearings 17, 19 mounted to the frame member 14. One of the Savonius blades 18 may be made a little heavier than the other one to ensure the perpendicularity of the windmill to the wind direction and thus easy start-up.

The lifting devices 22 are preferably embodied as a pair of respective pulleys mounted on the frame member 14 on each side of the barrier 10. In the preferred embodiment shown in FIG. 1, the pair of frame members 14*a* and 14*b* are provided, with one frame member 14*a* on a respective side of the barrier 10, and the other frame member 14*b* on the other side. In the preferred embodiment, two pairs of lifting devices 22 are provided, with each pair of lifting devices mounted to a respective frame member 14*a* and 14*b* on each respective side of the barrier 10 as shown. In the preferred embodiment, each pair of lifting devices 22 includes a pulley and a crank with each pulley operating to vertically move a respective supporting member 20 as a guided leg 27 and foot 42.

The lifting devices 22 are operatively connected to the axle 16 by a power transmission system on each side of frame 14, which includes a mechanical power train from the shaft 16 to each of the lifting devices 22. The power transmission system on each side of frame 14 includes a pair of V-belts 24 respectively engaging and rotating a respective pulley rotatably connected to a respective connecting rod, one for each supporting member 26, 28, 30, 32. Each connecting rod—or crank arm—38 is pivotably connected to a piston which slides upwardly and downwardly within a guide tube, each piston being connected to a respective guided leg 27 which has a foot 42 attached to the lower end.

Referring now to FIG. 4, the barrier 10 is generally to be positioned at a height H1, for example, within about ¾ to about 1¼ meters, but preferably about one meter or less, above the ground on the top of the sand dune or sand sheet surface. In operation, the barrier 10 operates as follows: blown sand will rotate the blades 18 forming the Savonius windmill, thus transferring the longitudinal motion into rotational motion. The shaft 16 rotates with the Savonius windmill and the pulleys 22 attached to shaft 16 translate the rotational energy into axial force-displacement energy through the respective connecting rod—or crank arm—38 of the respective slider crank mechanisms. The sand is stopped and dropped onto the sand dune as indicated by arrow "A". Each slider crank arm 38 drives a piston 37 and respective guided leg 27 of the barrier 10 to move longitudinally up and down within respective guide tubes 46, to thus cause the barrier 10 to gradually and incrementally lift itself up through the sand pile 12.

Figure 5:
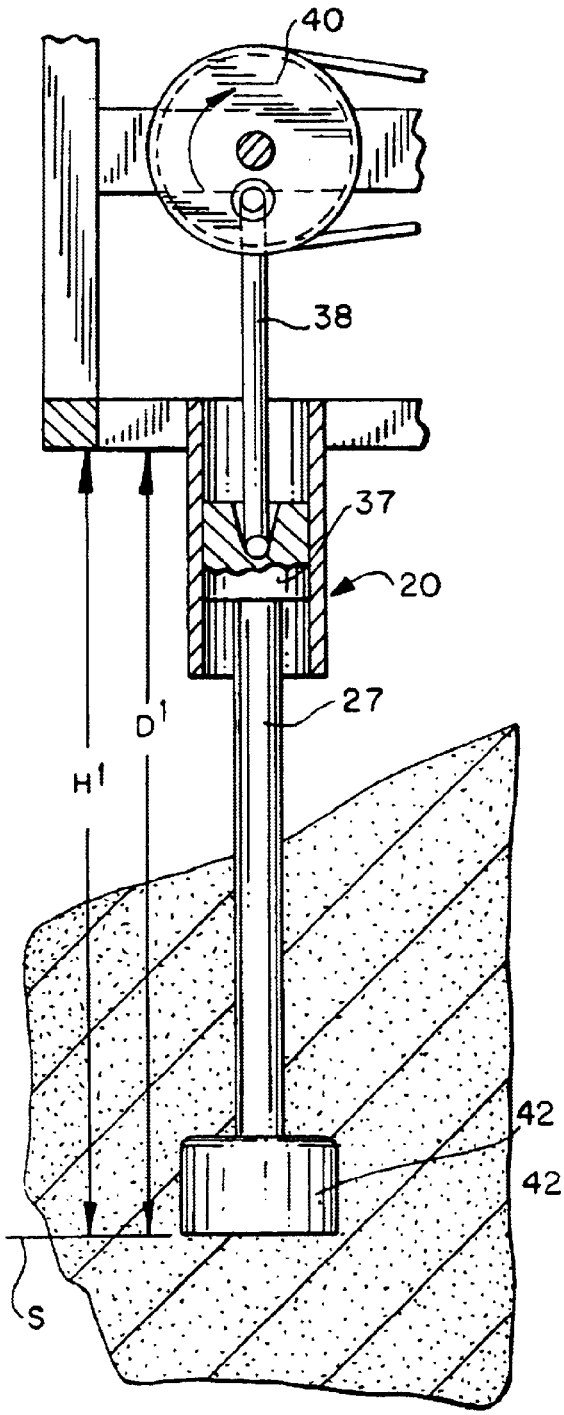
FIG. 5 is a side elevational view, partially in cross-section, of one corner section of the dynamic drift barrier, showing a supporting member and associated pulley and crank arm in a first stroke position.

FIG. 5 is a side elevational view partially in cross-section, of a typical supporting member 20, showing an exemplary pulley 40 in a first stroke position, with the bottom of foot 42 of the exemplary leg 27 generally parallel to an initial plane S in the sand at a distance D1 from the base 44 of the frame structure 14 of the barrier 10. This can be the initial position of the barrier 10 over the sand 12, such that D1 equals H1.

Figure 6:
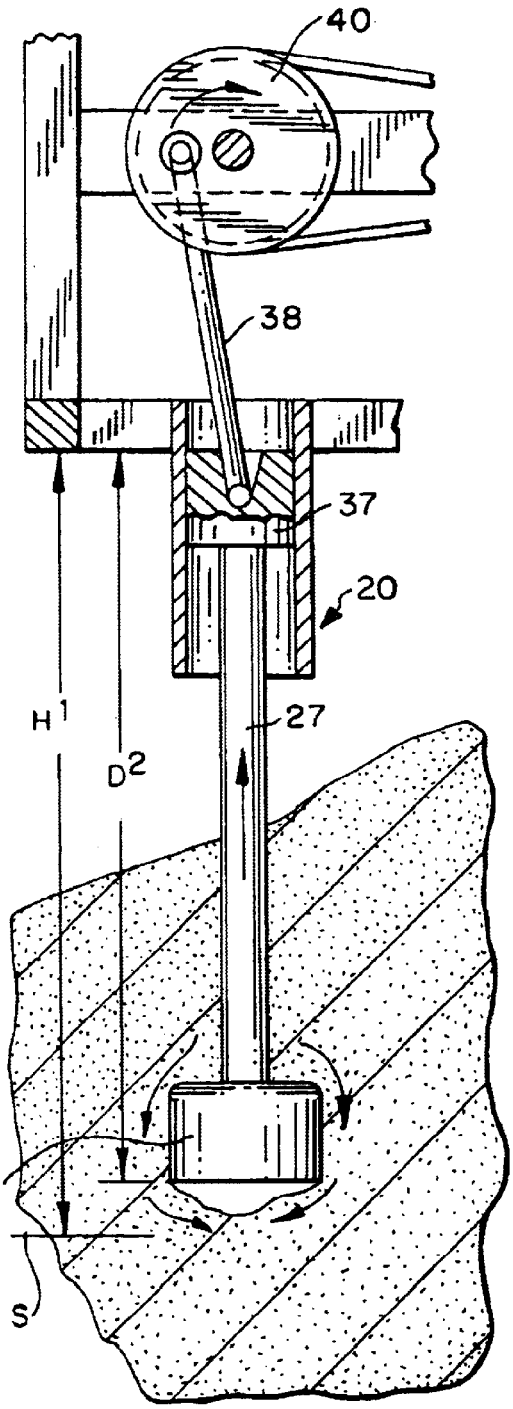
FIG. 6 is a side elevational view, partially in corner cross-section, of the section of the dynamic drift barrier of FIG. 5, showing the pulley and crank arm in a second stroke position.

FIG. 6 is a side elevational view, partially in cross-section, of the supporting member of FIG. 5, showing the pulley 40 in a second stroke position, with the leg 27 and foot 42 raised to a distance D2, which is less than H1, causing the sand around the foot 42 to move about and under the bottom of the foot 42, thereby displacing foot 42.

Figure 7:
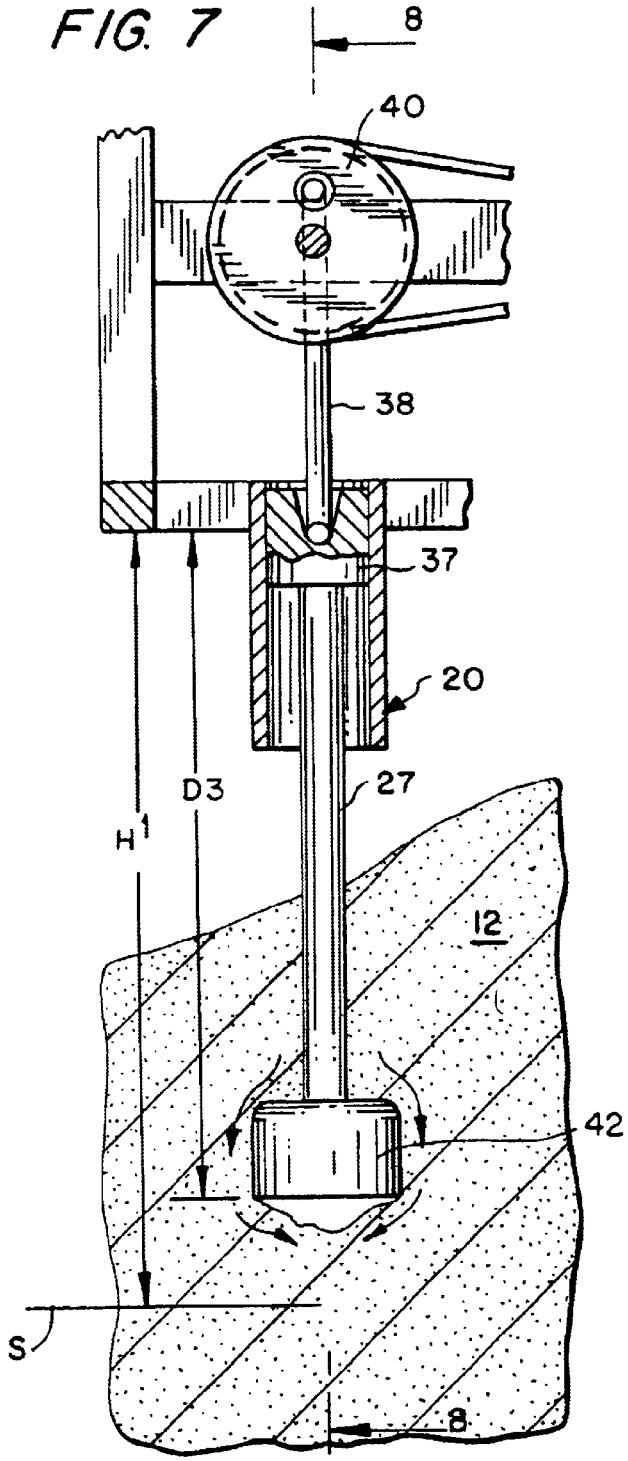
FIG. 7 is an elevational view, partially in cross-section, of the corner section of the dynamic drift barrier of FIG. 5 showing the pulley and crank arm in a third stroke position.

FIG. 7 is a side elevational view, partially in cross-section, of the supporting member 26 of FIG. 5, showing the pulley 40 in a third stroke position, with the leg 27 and foot 42 raised to a distance D3 which is less than H1 and less than D2. Since crank arm 38 and pulley 40 are at the 12:00 o'clock position in FIG. 7, D3 is the maximum distance to which foot 42 will be raised relative to the base 44, representing the maximum amount of sand 12 to move about the foot 42 and under the bottom of the foot 42.

Figure 8:
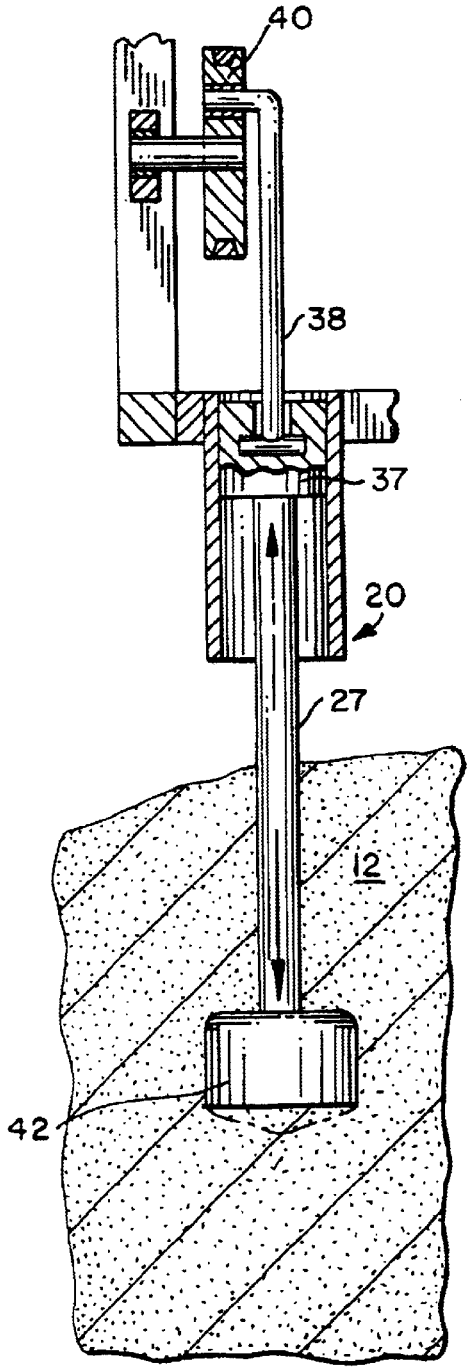
FIG. 8 is a cross-sectional view, taken along lines 8—8 of FIG. 7 and showing the pulley and crank arm in the third stoke position.

FIG. 8 is a front elevational view, partially in cross-section, taken along lines 8—8 of FIG. 7 of supporting member 26 of FIGS. 5–7, showing the exemplary pulley 40 in the third stroke position, with the crank arm 38 rotatably engaging an aperture in the pulley 40.

During the upward motion of the leg 27 shown in FIGS. 5–8, the entire apparatus 10 has not lifted; that is, the base 44 of the frame structure remains at a height H1 above the initial plane S in the sand 12. Some of the deposited sand in the pile 36 may slide downwardly and accumulate about the leg 27, giving a general appearance of the barrier 10 temporarily sinking into the sand 12.

Figure 9:
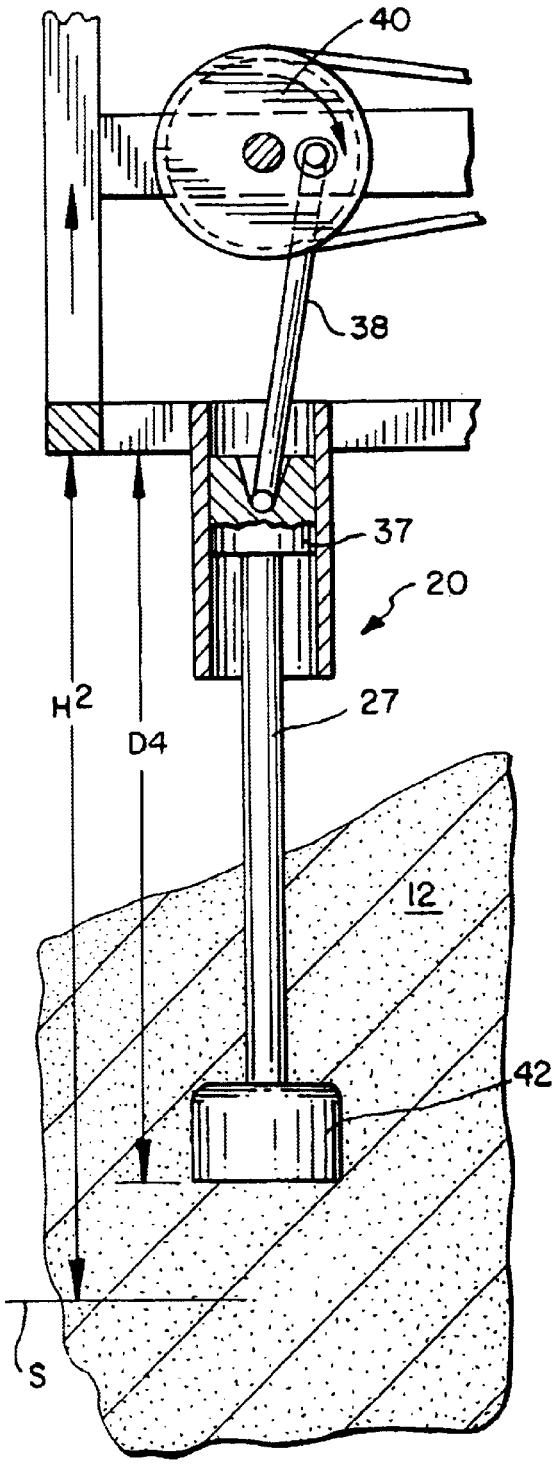
FIG. 9 is a side elevational view, partially in cross-section, of the corner section of the dynamic drift barrier of FIG. 5, showing the pulley and crank arm in a fourth stroke position.

FIG. 9 is a side elevational view, partially in cross-section of the supporting member 20 of FIGS. 5–8, showing the exemplary pulley 40 of FIG. 5 in a fourth stroke position, in which the leg 27 and foot 42 are pushed downwardly into the sand to a distance D4 from the base 44, causing the base 44 of frame 14 to lift upward to a height H2 from the plane S, with H2 being greater than or equal to H1.

Figure 10:
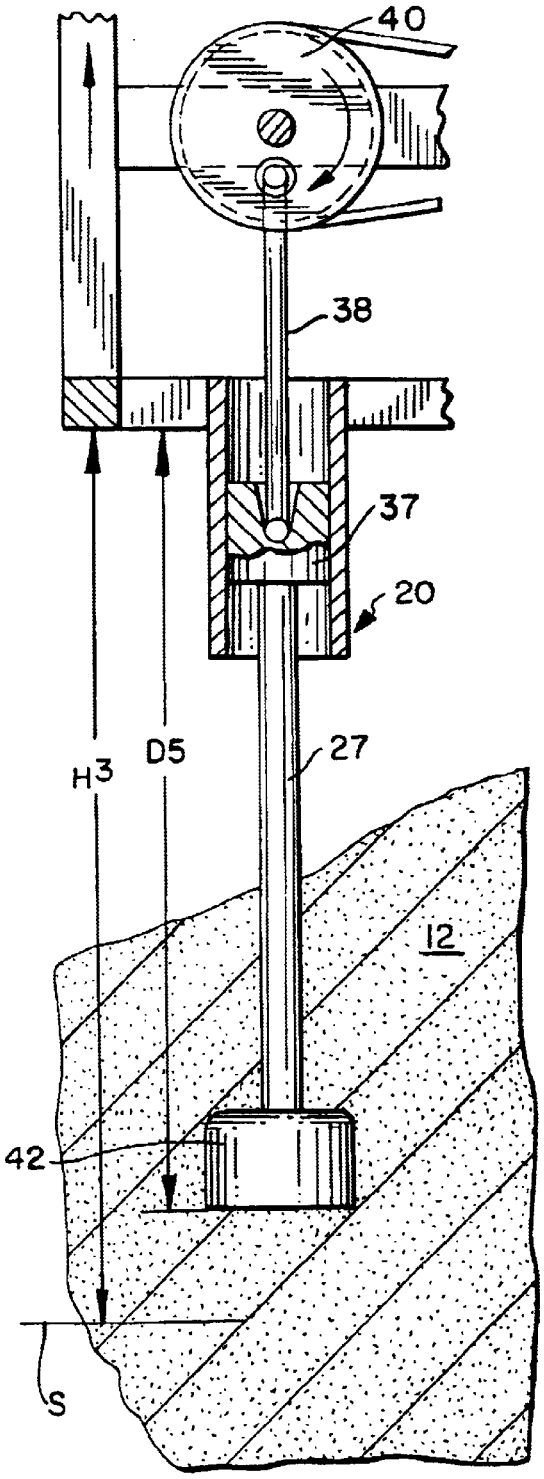
FIG. 10 is a side elevational view, partially in cross-section, of the corner section of dynamic drift barrier of FIG. 5, showing the pulley and crank arm after they have returned to the first stroke position of FIG. 5.

FIG. 10 is a side elevational view, partially in cross-section, of the supporting member 26 of FIGS. 5–9, showing the exemplary pulley of FIG. 5 after it has returned to the first stroke position, in which the leg 27 and foot 42 are pushed downwardly into the sand to the maximum distance D5 from the base 44, causing the base 44 to lift upward to a maximum height H3 from the plane S, with H3 being greater than or equal to H2. With the first stroke position in FIG. 10 being identical to the first stroke position illustrated in FIG. 5, the distance D5 is generally equal to the distance D1, since the pulley 40 and leg 26 have returned to their initial positions, although the barrier 10 has been lifted to the height H3 which is greater than the height H1.

The difference H3–H1 is the step size of the barrier 10. The amplitude of the crank arm 38, which controls step size or stroke length, can be adjusted to provide the least amplitude movement of the leg 27 necessary to keep the barrier 10 on the top of the sand dune and thus avoid sand accumulation. For example, the crank arm amplitude can be controlled by replacing the crank arm 38 of a given length with another crank arm 38 of a different length, such as a longer or shorter crank arm 38. Accordingly, the crank arms 38 essentially comprise amplitude control systems for controlling the stroke of the periodic vertical displacement of the supporting members 20. Alternatively, the crank arm 38 can be made adjustable in length and attached to the pulley by an adjusting pin which would enter one of several apertures in the crank arm 38, and an aperture in the pulley 40 located at a preselected radial and angular location.

Transported sand will be deposited by the Savonius windmill working as a very wide horizontal slat, and the blown sand energy will drive the four legs 26 of the barrier 10 vertically so that each foot 42 will readjust its height, as the sand is blown, and as the sand is deposited in the pile 36 under the barrier 10.

A plurality of the barriers 10, incorporating the windmill apparatus, can be positioned in a flanking array on the landscape to thereby reduce the advancement of sand 12 or other particles over an area of the surface downwind of the plurality of windmill apparatus 10.

Figure 11:
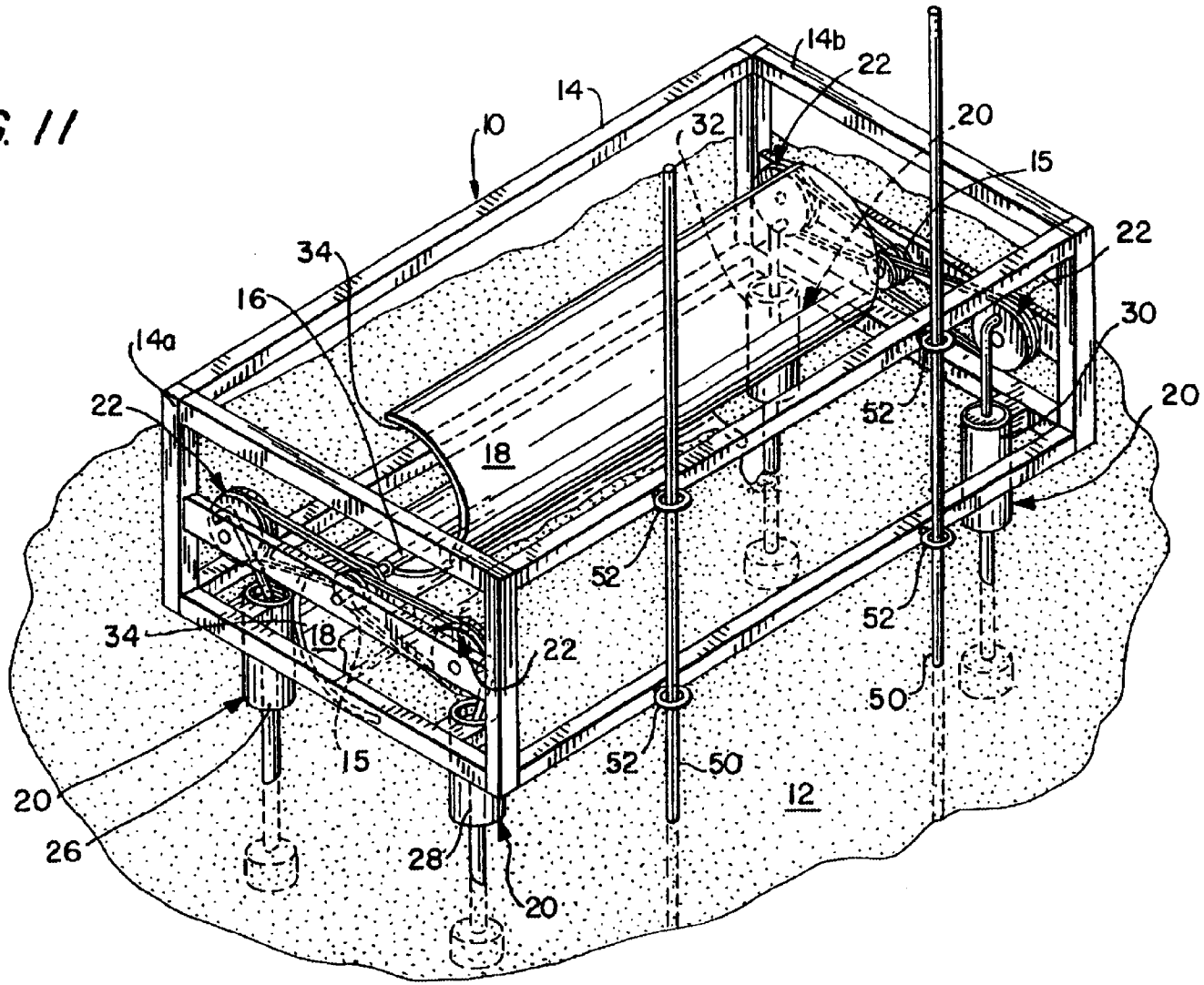
FIG. 11 is a view similar to FIG. 1, illustrating an alternative embodiment of the invention, wherein the dynamic drift barrier is tethered to retain its position by a plurality of poles or stakes extending through eye bolts attached to the frame and driven into the sand.

Referring now to FIG. 11, there is shown an advantageous embodiment of the present invention in which a plurality of upright rods or stakes 50 are driven into the sand pile and made to extend through a corresponding plurality of eye bolts 52 in order to tether the apparatus 10 to maintain the position of the apparatus by preventing it from "walking" from the original position. In particular, if the apparatus were left untethered, the upward and downward movement of the support legs and corresponding feet will tend to cause the apparatus to drift from one position to the next as the movement takes place. By incorporating a plurality of upright poles sunken into the sand and made to extend through eye bolts 52 which act as tethers, the apparatus will be prevented from drifting from its initial position.

The apparatus can also include additional refinements such as a level sensing device, a programmable electronic computer, a storage battery and solar panels to optimize the stability and desired operating configuration of the windmill assembly. A transmitter associated with the axle would produce a radio signal or the like in the event the windmill blades accidentally become jammed by sand.

Although the invention has been described in detail with reference to the illustrated preferred embodiments, variations and modifications may be provided within the scope and spirit of the invention as described and as defined by the following claims.

I claim:

1. An apparatus for depositing particles carried in moving air currents, which comprises:

a frame member;

a generally horizontal axle mounted for rotation on said frame member;

a plurality of blades secured to the horizontal axle for receiving and depositing such particles under the frame member and for rotatably moving with the axle caused by movement of the air currents and particles;

a plurality of vertically displaceable supporting members attached to and depending from the frame member;

lifting device associated with the frame member and each of the plurality of supporting members for vertically displacing each of the plurality of vertically displaceable supporting members; and power transmission means operatively associated with said horizontal axle and each of the lifting devices for transferring the energy of rotation of the horizontal axle to each said lifting devices for causing the vertically displacement of each of the plurality of vertically displaceable supporting members;

whereby rotation of the horizontal axle by movement of the plurality of blades produces a periodic vertical displacement of each of the supporting members to lift the frame structure with respect to the deposited particles.

2. The apparatus of claim 1, wherein said plurality of blades includes at least two blades.

3. The apparatus of claim 1, wherein said at least two blades comprises a Savonius windmill.

4. The apparatus of claim 1, wherein said blades are rigid.

5. The apparatus of claim 1, wherein the surface of said blades is coated with an abrasion-resistant material such as polyvinyl chloride, hardened metal alloy or composite materials.

6. The apparatus of claim 1, wherein said blades are made of an abrasion resistant material such as plastic, or composite materials.

7. The apparatus of claim 1, which further comprises amplitude control means for controlling the stroke of the periodic vertical displacement of the supporting members.

8. The apparatus of claim 1, wherein said power transmission means includes a mechanical power train from said axle to each of said plurality of lifting devices.

9. The apparatus of claim 1, wherein said plurality of vertically displaceable supporting members includes four supporting members.

10. The apparatus of claim 1, which further comprises an articulated support plate attached to each of the plurality of supporting members.

11. The apparatus of claim 10, wherein said articulated support plates are attached to the free end of each said supporting members.

12. The apparatus of claim 10, wherein a plurality of such support plates are attached to the exterior surface of at least one of the plurality of supporting members.

13. The apparatus of claim 1, which further comprises signal transmission means operatively connected to said axle.

14. The apparatus of claim 1, wherein the free ends of said supporting members are positioned on the earth's surface, said horizontal axle being supported at a distance of about one meter above the surface and normal to the prevailing direction of air currents carrying suspended particles, whereby said frame member self-adjusts its vertical position to maintain said axle and blades above the deposited particles.

15. The apparatus of claim 1 wherein each said vertically displaceable supporting members comprises a guiding tube having a piston slidable therein, said slidable piston having a crank arm pivotably attached thereto, said crank arm being connected to said power transmission means to slidably move said piston upwardly and downwardly within said guiding tube, said piston having a leg member attached thereto on the side opposite said crank arm, said leg member having a foot attached to the free end thereof for engagement with the sand to support said frame member thereon.

16. The apparatus of claim 15, wherein said crank arm is replaceable by a crank arm of different length to vary the length of the stroke.

17. The apparatus of claim 15, wherein said crank arm includes a plurality of apertures for attachment to said power transmission means by a pin made to extend through a selected aperture and into said power transmission means.

18. The apparatus of claim 15, wherein said power transmission means comprises a pair of pulleys on each end of said axle, and a pair of drive belts are connected to said axle and said pulleys, said crank arm of each said supporting member being attached to said pulleys at a selected radial location so as to move upwardly and downwardly when said pulleys rotate caused by energy transmitted by air currents and particles carried thereby.

19. The apparatus of claim 16 wherein said power transmission means comprises a pair of pulleys on each end of said axle, and a pair of drive belts are connected to said axle and said pulleys, said crank arm of each said supporting member being attached to said pulleys at a selected radial location so as to move upwardly and downwardly when said pulleys rotate caused by energy transmitted by air currents and particles carried thereby.

20. The apparatus of claim 18, wherein each said pulley is operated by a V-belt.

21. The apparatus according to claim 19, wherein the point of connection between each said crank arm and each said pulley is offset by 90 degrees from the point of connection of the next adjacent pulley.

22. An apparatus for depositing particles carried by moving arm current, which comprises:

a) a frame member;

b) a horizontal axle bearing mounted to said frame member for rotation;

c) at least two windmill blades attached to said axle to form a Savonius-type windmill for engagement by the air currents and for receiving and depositing such particles beneath said frame member, said windmill blades rotatably moving with said axle by energy imparted thereto by the air currents and particles carried thereby;

d) a plurality of vertically displaceable supporting members attached to said frame member and depending therefrom, each said supporting member including:

i) a guiding tube;

ii) a piston slidable upwardly and downwardly within said guiding tube;

iii) a crank arm attached to the upper portion of said piston; and iv) a leg member attached to the lower portion of said piston, said leg member having a support foot attached to the lowermost free end thereof;

e) power transmission means adapted to convert energy from the wind currents and particles carried thereby to rotational movement of a plurality of pulleys, each said pulley having at least one of said crank arms attached thereto, whereby rotation of said pulleys causes correspondingly rotation and upward and downward movement of each said crank arm to cause each said support leg and attached support foot to move upwardly and downwardly with a sand pile accumulated by said windmill to cause said frame member to periodically rise to maintain a position within a predetermined dimensional range at or near the top of the sand pile.

23. An apparatus for depositing particles carried in moving air currents, which comprises:

a frame member positionable on a surface and in the air currents at a predetermined height location above the surface;

a generally horizontal axle mounted for rotation on said frame member;

a plurality of windmill blades attached to said axle to form a Savonius-type windmill for engagement by air currents and for receiving and depositing and accumulating such particles beneath said frame member so as to progressively raise the level of the surface of such particles on which said frame member is positioned, said windmill blades rotatably moving with said axle by energy imparted thereto by the air currents and particles carried thereby; and means to maintain the height of said frame member with respect to the surface of such particles within a predetermined dimensioned range by progressively raising said frame member as such particles are deposited and accumulated.

24. The apparatus of claim 23, wherein said means to maintain the height of said frame member with respect to the surface of such particles comprises a plurality of vertically displaceable supporting member attached to and supporting said frame member, each said supporting member adapted to progressively raise said frame member in accordance with the level of the surface of such particles as such particles are accumulated beneath said frame member, to maintain the height of said frame member with respect to the upper surface of such particles within a predetermined range.

25. An apparatus for depositing sand particles carried by moving air currents, which comprises:

a frame member positionable on a surface and in the air currents at a predetermined height location above the surface;

a generally horizontal axle mounted for rotation on said frame member;

a plurality of windmill blades attached to said axle to form a savonius-type windmill for engagement by air currents and for stopping and depositing and accumulating such particles beneath said frame member so as to progressively raise the level of the surface of such particles on which said frame member is positioned;

a support device attached to and depending from said frame member at a predetermined number of locations sufficient to support said frame member in a stable manner, each said support device being capable of adjusting the position of the portion of said frame member from which it depends as the height level of accumulated particles thereunder increases; and system for causing said support devices to adjust their positions with respect to the level of such accumulated particles in a manner to maintain the height location of said frame member within a predetermined range.

26. The apparatus according to claim 25, wherein said system for causing said support devices to adjust their positions with respect to the level of such accumulated particles comprises a power transmission system operatively associated with said longitudinal axle and said support devices for transferring the energy of rotation of the horizontal axle to each said support device for causing each said support device to adjust the position in the manner to maintain the height dimension of said frame member above the level of such accumulated particles within a predetermined range.

27. The apparatus according to claim 26, wherein said predetermined range is between about ¾ to about 1¼ meter.

28. The apparatus according to claim 27, wherein said range is about one meter.

29. A method of stopping and depositing air-borne particles from air currents moving proximate a surface, comprising:

a. providing a self-adjusting Savonius windmill apparatus, the axle of which is mounted to a frame member equipped with a plurality of vertically displaceable supporting members; and b. positioning the windmill apparatus on a surface and in the air currents with the axle normal to the prevailing direction of the air currents, whereby particles impacting the blades of the windmill are stopped and deposited and accumulated on the surface.

30. The method of claim 29, further comprising positioning a plurality of the windmill apparatus in a flanking array to thereby reduce the advancement of particles over an area of the surface downwind of the plurality of windmill apparatus.

* * * * *